US005678322A

United States Patent [19]

Potter

[11] Patent Number: 5,678,322

[45] Date of Patent: Oct. 21, 1997

[54] JAM DETECTOR FOR WOOD VENEER DRYER

[75] Inventor: Joseph T. Potter, Eugene, Oreg.

[73] Assignee: AKI Dryer Manufacturers, Inc., Eugene, Oreg.

[21] Appl. No.: 769,150

[22] Filed: Dec. 18, 1996

[51] Int. Cl.[6] ..... F26B 19/00

[52] U.S. Cl. ..... 34/217; 250/222.1

[58] Field of Search ..... 34/203, 216, 217; 250/559.12, 559.13, 222.1

[56] References Cited

U.S. PATENT DOCUMENTS

| | | | |
|---|---|---|---|
| 4,417,406 | 11/1983 | Eibich | 34/217 |
| 4,544,841 | 10/1985 | Bright et al. | 250/222.1 |
| 5,243,183 | 9/1993 | Barron, Jr. et al. | 250/222.1 |
| 5,371,583 | 12/1994 | Yamaguchi | 250/222.1 |
| 5,504,346 | 4/1996 | Page et al. | 250/559.13 |
| 5,560,410 | 10/1996 | Peacock | 144/362 |

*Primary Examiner*—Henry A. Bennett
*Assistant Examiner*—D. Doster
*Attorney, Agent, or Firm*—John L. Rogitz

[57] ABSTRACT

An end wall of a multi-conveyor wood veneer dryer includes a plurality of sight glasses that are vertically aligned with each other. Each sight glass is elevated just above a respective roller conveyor, with the conveyors being located in the dryer. A laser generator portion of a laser apparatus is positioned adjacent each sight glass outside the dryer, such that a laser beam is directed through each sight glass. Each laser apparatus includes a light detector for detecting reflected laser light. The preferred laser apparatus generates a distance signal representative of the distance between the generator and an object in the path of the laser beam, based on the period from when the beam was generated to when the reflected beam was received. Accordingly, when the veneer panels in a conveyor are moving properly through the dryer, the laser beam that is associated with the conveyor propagates to the wall of the dryer that is opposite the sight glasses, and the beam is reflected back to the receiver, with the apparatus indicating a distance equal to the length of the dryer. On the other hand, when the panels in a conveyor become jammed and consequently stacked up, the beam is reflected by one or more jammed panels, with the output of the laser apparatus indicating the distance from the laser generator to the jam.

12 Claims, 4 Drawing Sheets

JAM DETECTOR FOR WOOD VENEER DRYER

FIELD OF THE INVENTION

The present invention relates generally to industrial dryers, and more particularly to methods and apparatus for detecting jams in wood veneer dryers.

BACKGROUND

Plywood is made by laminating together panels of wood veneer. In turn, the wood veneer panels are made by manufacturing the veneer panels in accordance with well-known means, and then drying the panels in a large dryer. Usually, the panels are conveyed through the dryer while hot air is circulated through the dryer, to thereby remove excess moisture from the panels.

A typical wood veneer dryer includes several layers of conveyors. Each conveyor layer typically is established by alternating sets of rollers and guide channels. More specifically, each conveyor typically includes sets of two transversely-oriented rollers, with the two rollers in each set being vertically in tandem. Between adjacent roller sets is a stationary hollow transverse guide channel through which hot air is directed. The rollers are rotated by a common motor-driven chain drive, and the panels are advanced into one end of the dryer between the rollers of the first roller pair, with the cooperation of the rollers slowly advancing each panel between the rollers, through the first guide channel, and thence between the rollers of the second roller pair, and so on.

As recognized by the present invention, while existing dryers are effective, it happens that from time to time a veneer panel can become jammed in a conveyor. The jamming can be caused by misalignment of the panel with the rollers, attributable to warpage of the panel and other reasons. In any case, when a panel becomes jammed, the panels following it also become jammed, and the panels consequently stack up on each other at the point of jamming. As further recognized by the present invention, this jamming usually is not detected until some time after it occurs, i.e., when an operator happens to notice that veneer panels are no longer exiting the jammed conveyor. The present invention appreciates that under the above-noted circumstances, not only can the jammed panels become ruined, but because of the delayed detection of the jamming, an inordinate amount of processing time is lost.

Still further, the present invention recognizes that once the jamming is detected, the dryer must be shut down, the location of the jamming within the dryer must be determined, and then the jamming corrected. It happens, however, that determining the location of the jamming is not trivial. This is because existing dryers typically are hundreds of feet long. Consequently, it might be necessary to enter a number of access doors along the length of the dryer before the source of the jamming can be visually determined, and this prolonged inspection period undesirably consumes additional time that otherwise could be spent processing the veneer panels.

Accordingly, it is an object of the present invention to provide a method and apparatus for quickly detecting the occurrence of jamming in a wood veneer panel dryer. Another object of the present invention is to provide a method and apparatus for rapidly determining the location of a panel jam in a wood veneer panel dryer. Still another object of the present invention is to provide a method and apparatus for quickly detecting the occurrence of jamming in a wood veneer panel dryer that is easy to use and cost-effective.

SUMMARY OF THE INVENTION

A veneer dryer includes a dryer housing that has at least one conveyor for conveying veneer panels from a first end of the dryer toward a second end of the dryer. A laser apparatus directs a laser beam above the conveyor, and the laser apparatus generates a distance signal which is representative of the distance between the laser apparatus and an object intersecting the laser beam.

In a preferred embodiment, the veneer panels establish an operating configuration, wherein each panel lays substantially flush against the conveyor and the panels are thereby conveyed through the dryer. The veneer panels can also establish a jammed configuration, wherein plural panels are stacked. Accordingly, the laser apparatus is inventively disposed such that the laser beam propagates from one end of the dryer housing to the other when the panels are in the operating configuration, while impinging on at least one panel when the panels are in the jammed configuration.

Preferably, one of the ends of the dryer housing is covered by a wall, and the dryer further includes a sight glass positioned in the wall to establish a light passageway into the dryer housing. With this structure, the laser apparatus is positioned outside the dryer housing and is disposed to direct the laser beam through the sight glass. Advantageously, the dryer includes a plurality of conveyors, with the conveyors being horizontally oriented and arranged in a stacked relationship with each other. A plurality of laser apparatus are provided, each apparatus being associated with a respective conveyor.

In one presently preferred embodiment, the laser apparatus of the present invention includes a laser beam generator and a light detector for receiving reflections of the laser beam from an object in the path of the beam. A processor is in data communication with the laser beam generator and the light detector for determining a distance between the apparatus and the object.

In another aspect, a combination in a veneer dryer includes a sight glass positioned on the dryer to establish a pathway for light from outside the dryer to inside the dryer. Also, the combination includes a laser apparatus juxtaposed with the sight glass for directing a laser beam into the dryer and receiving a reflection of the beam. The laser apparatus generates a signal in response thereto that is representative of whether veneer panels in the dryer have jammed.

In still another aspect, a method for generating a signal representative of whether veneer panels in a veneer dryer have jammed includes directing a light beam into the dryer. Moreover, the method includes receiving a reflection of the light beam, and then generating the signal in response to the receiving step.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
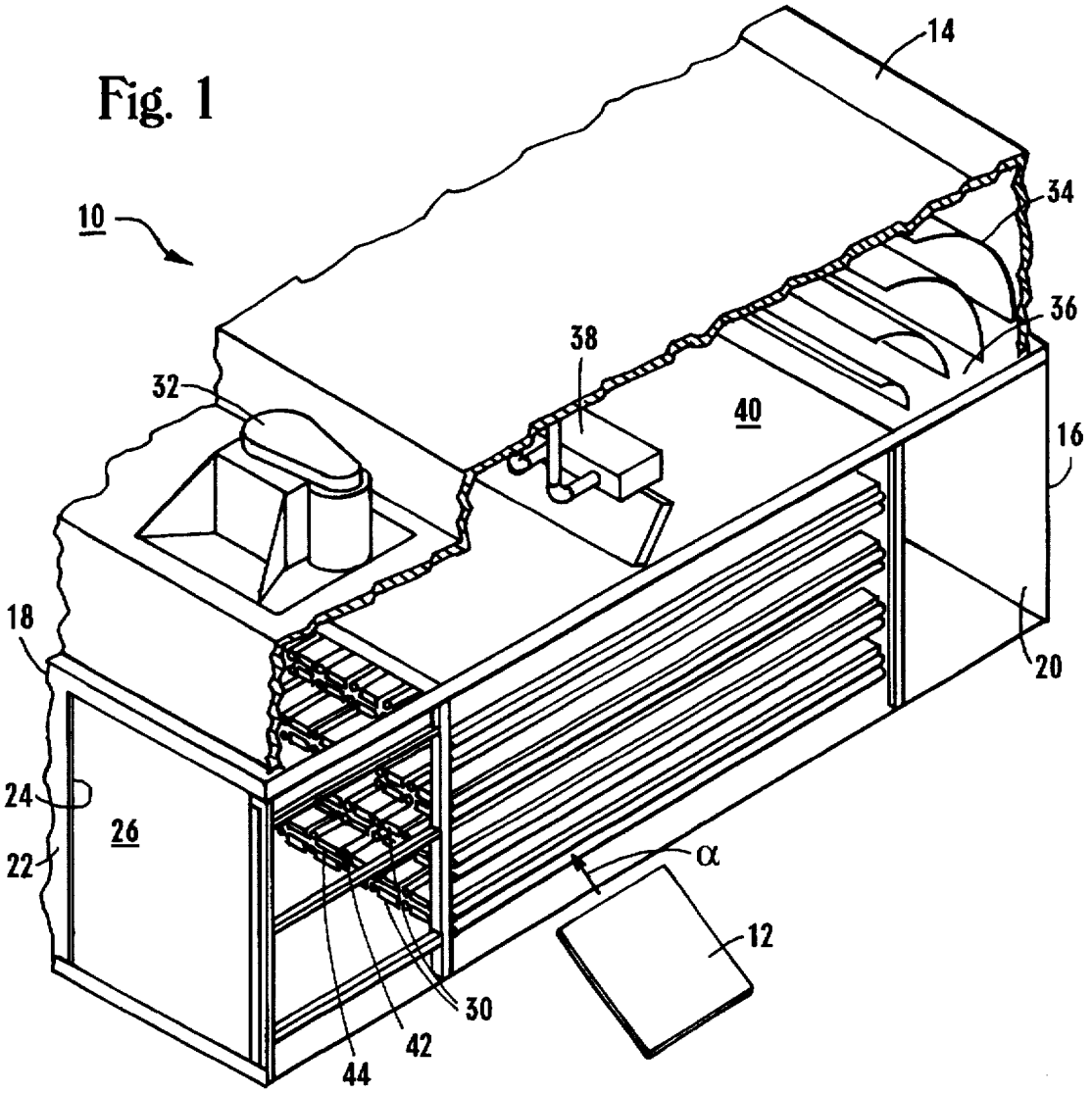
FIG. 1 is an exploded perspective view of a portion of a wood veneer panel dryer of the present invention.

Referring initially to FIG. 1, a dryer is shown, generally designated 10, for removing excess water from construction panels 12 (only one panel 12 shown in FIG. 1). The panels 12 can be veneer panels, to be subsequently laminated together by means well-known in the art to make plywood. It is to be understood that the dryer 10 can also be used to dry gypsum boards to be used as wall boards in buildings.

In accordance with principles well-known in the art, the dryer 10 can be established by a plurality of hollow subassemblies that are juxtaposed end-to-end. The dryer 10 includes a housing 14, and the housing 14 defines opposed ends 16, 18 that are respectively enclosed by first and second walls (shown and discussed further below in reference to FIGS. 2 and 3).

Additionally, the housing 14 defines first and second opposed vertical sides 20, 22 that extend between the ends 16, 18 of the housing 14. Preferably, each vertical side 20, 22 is formed with a respective access opening 24 that is selectively covered by a respective door 26. As shown, in one preferred embodiment the access opening 24 of the present invention is rectangular, and more preferably is about eight feet by eight feet (8'×8') or indeed ten feet by ten feet square (10'×10'). Details of the preferred door 26 are set forth in the present assignee's co-pending U.S. patent application Ser. No. 08/768,655, filed Dec. 18, 1996, for an invention entitled "VERTICAL LIFT DOOR FOR GYPSUM BOARD DRYER OR VENEER BOARD DRYER", incorporated herein by reference.

The dryer 10 includes interior structure as shown for conveying and drying by heat the panels 12 in accordance with principles well-known in the art. More particularly, the dryer 10 includes tiered horizontal roller conveyors 30 which convey the panels 12 longitudinally (i.e., in the direction of the arrow a) through the dryer 10. In other words, the conveyors 30 are horizontally oriented and arranged in a stacked relationship with each other.

Also, the dryer 10 includes a plurality of blowers 32, a plurality of air baffles 34, and plural riser/downcomer plenums 36. Further, burners or heaters 38 are disposed in top plenums 40 of the dryer 10. In the presently preferred embodiment, each blower 32 cooperates with its air baffles 34, riser/downcomer plenums 36, top plenum 38, and burner 40 to direct hot gas horizontally across the panels 12, to thereby dry the panels 12 as they are conveyed through the dryer 10.

With particular respect to the conveyors 30, each conveyor 30 includes a plurality of sets of transversely-oriented rollers 42. As shown, each set of rollers 42 includes a pair of vertically tandem rollers 42. Also, between adjacent sets of rollers 42 are hollow, elongated, generally parallelepiped-shaped, transversely-oriented guide channels 44.

Per the present invention, the bottom rollers 42 of each tandem roller pair are rotated by means well-known in the art, e.g., a motor-powered chain drive. As the rollers 42 rotate, they cooperate to advance the panels 12 longitudinally through the dryer 10, i.e., between the rollers 42 in each pair of rollers, into the succeeding guide channel 44, and from thence between the rollers 42 in the next roller pair, and so on. As the panels are so conveyed, the guide channels 44 direct hot gas against the panels 12 to dry the panels 12. The top rollers 42 of each tandem roller pair ride on the panels 12 as the panels 12 are conveyed between the rollers 42.

Figure 2:
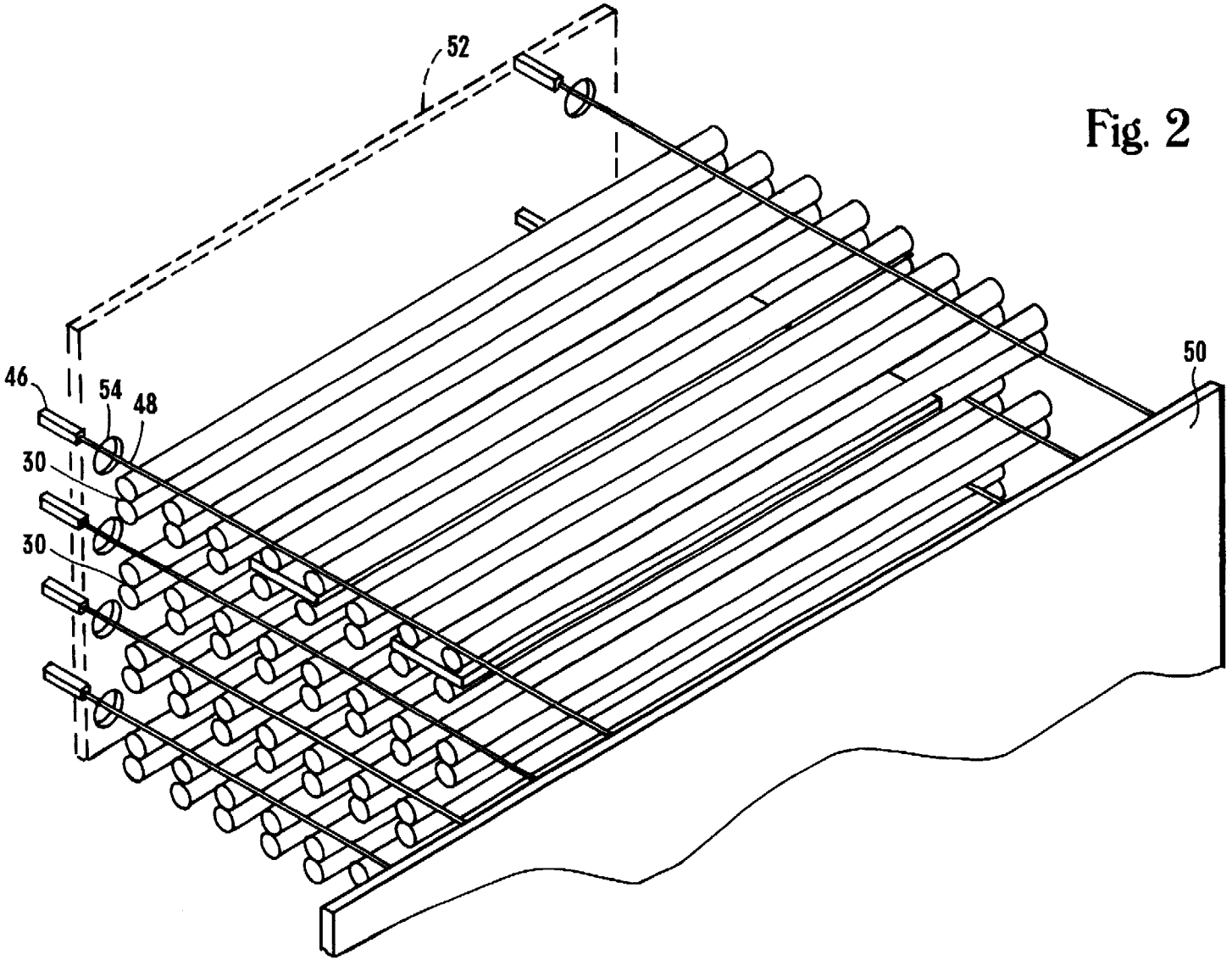
FIG. 2 is a schematic view showing the path of the laser beam when no conveyor jam exists, showing only the panels and conveyor rollers, showing portions of the end walls broken away or in phantom for clarity, and showing panels in the top conveyor only.

FIG. 2 shows that because, as the present invention recognizes, panels 12 can from time to time become jammed, the dryer 10 includes at least one and preferably a plurality of laser apparatus 46 for detecting jams. In the preferred embodiment, each conveyor 30 of the dryer 10 is associated with two respective laser apparatus 46, with one apparatus 46 of a conveyor 30 being positioned near the first side 20 and the other apparatus 46 being positioned near the second side 22 as shown.

Figure 3:
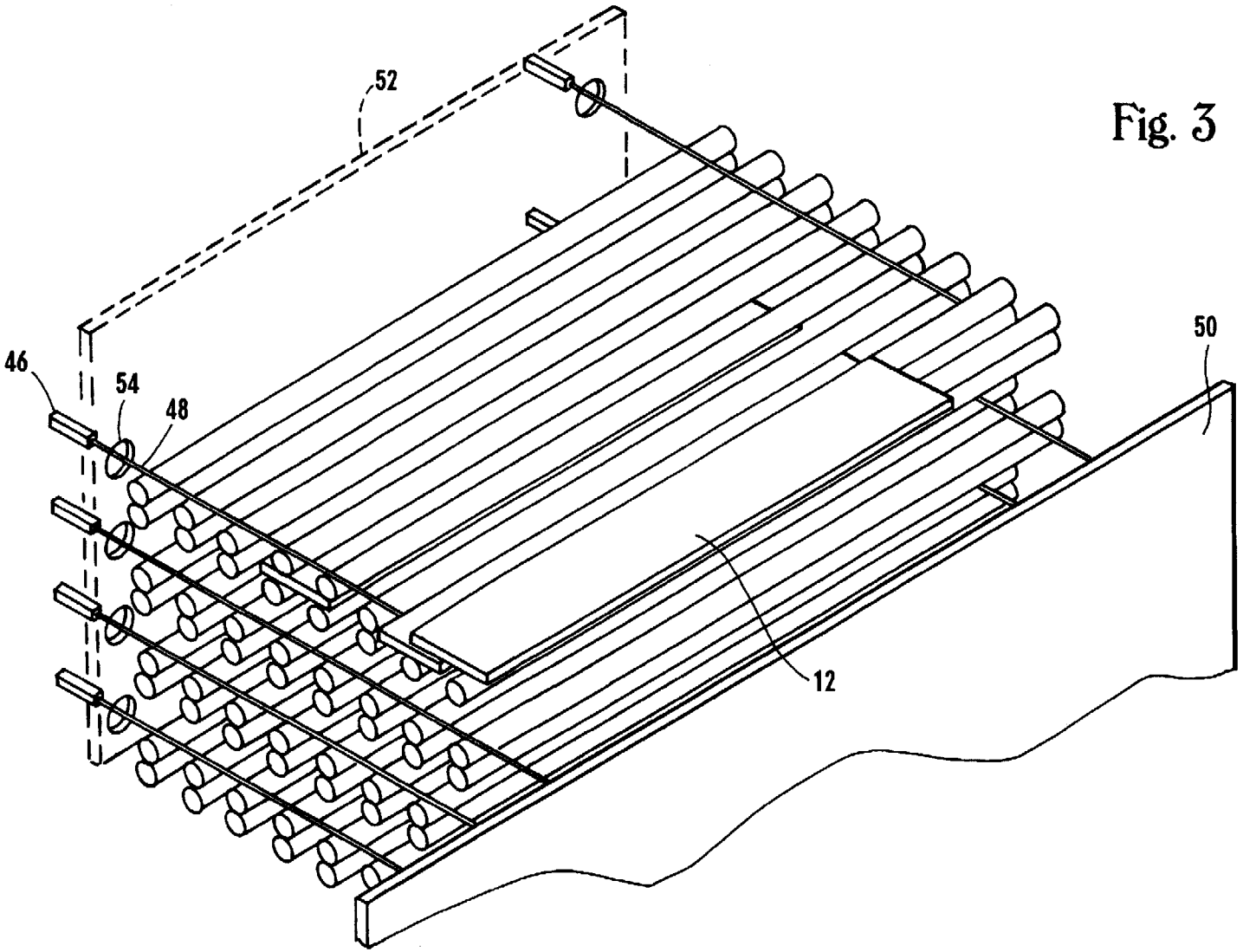
FIG. 3 is a schematic view showing the path of the laser beam when a conveyor jam exists, showing only the panels and conveyor rollers and showing portions of the end walls broken away or in phantom for clarity, and showing panels in the top conveyor only.

FIGS. 2 and 3 show the operation of a laser apparatus 46 of the present invention. As shown in FIG. 2, each laser apparatus 46 directs a respective laser beam 48 above the associated conveyor 30. As described in greater detail below, each laser apparatus 46 generates a distance signal that is representative of the distance between the laser apparatus 46 and an object intersecting the laser beam 48.

When the veneer panels 12 establish an operating configuration shown in FIG. 2 (panels 12 shown in only one of the conveyors 30 for clarity), in which each panel 12 lays substantially flush against its conveyor 30 and the panels 12 are thereby conveyed through the dryer 10 as shown in FIG. 2, the laser beams 48 are sufficiently above the panels 12 such that the beams 48 do not impinge on the panels 12. Instead, in the operating configuration the laser beams 48 propagate to a transverse far wall 50 of the dryer 10 and are reflected by the wall 50 back to the laser apparatus 46.

It is to be understood that the laser apparatus 46 are oriented to direct their respective beams 48 against the far wall 50 at an angle slightly offset from 90°, such that the reflected (i.e., returning) portion of each beam does not interfere with the unreflected (i.e., outgoing) portion. The reflected beams are then detected and the distance signal generated in response, as mentioned above and discussed further below. It is to be further understood that the far wall 50 encloses one of the ends 16, 18 of the housing 14 shown in FIG. 1.

In contrast, when the veneer panels 12 establish a jammed configuration (FIG. 3), in which plural panels 12 are stacked on top of each other, one or more of the beams 48 cannot propagate to the far wall 50. Instead, the laser beam impinges on at least one panel 12 when the panels are in the jammed configuration. The reflected beam is then detected and the distance signal generated in response, as mentioned above and discussed further below.

In accordance with the present invention, the laser apparatus 46 are not disposed inside the dryer 10. Instead, a transverse near wall 52 of the dryer 10, which is opposite the far wall 50 and which covers the other end 18, 16 of the housing 14, is formed with a plurality of vertically aligned transparent sight glasses 54 such that each sight glass 54 establishes a respective light passageway into the dryer 10 above a respective conveyor 30. The laser apparatus 46 are positioned outside the dryer 10, and each laser apparatus 46 is disposed to direct its laser beam through a respective sight glass 54. In other words, each laser apparatus 46 is juxtaposed with a respective sight glass 54 for directing a laser beam 48 into the dryer 10 and receiving a reflection of the beam 48. Preferably, the laser apparatus 46 are affixed to the near wall 52 by bolting or other mounting means known in the art.

Figure 4:
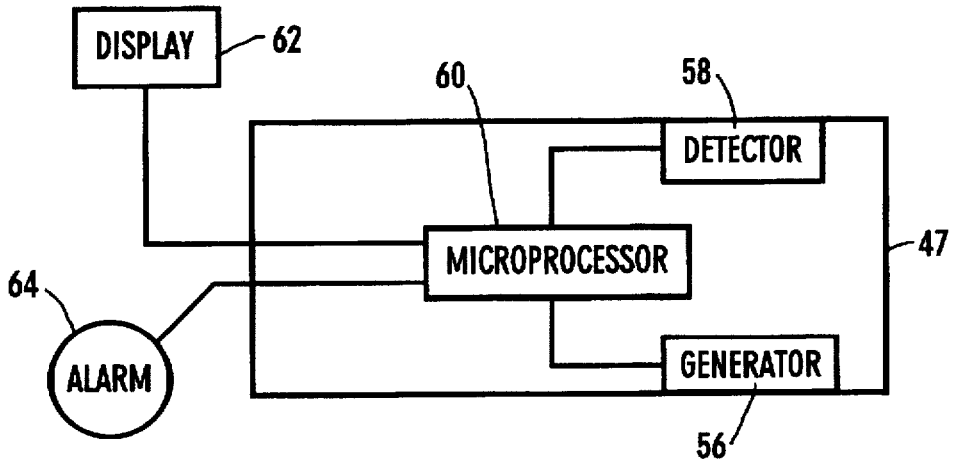
FIG. 4 is an electrical schematic diagram of a laser apparatus of the present invention.

FIG. 4 shows the details of a laser apparatus 46 of the present invention. As shown, the laser apparatus 46 includes an enclosure 47 the holds a laser beam generator 56 and a light detector 58 for receiving reflections of the laser beam 48 from an object in the path of the beam 48. A processor 60 is in data communication with the laser beam generator 56 and the light detector 58 for determining a distance between the laser apparatus 46 and the reflecting object. In one embodiment, the processor determines the distance by multiplying the speed of photons in the laser beam 48 times one-half of the time period from when the beam 48 was generated by the generator 56 to when its reflection was received by the detector 58. Thus, the beams 48 can be pulses of laser light, although for illustration purposes the beams 48 are shown as continuous beams. In the presently preferred embodiment, the laser apparatus 46 can be obtained from Leica AG Heerbrugg, Switzerland.

Desirably, each laser apparatus 46 also includes a display 62. The display 62 presents a graphical or alpha-numeric display of the distance signal, so that an operator of the dryer 10 can look at the display 62 and know whether a jam exists and if so, where longitudinally is exists. Moreover, when the distance signal falls below a threshold that is equivalent to the expected distance, i.e., the distance between the near and far walls 52, 50, an audible or visible alarm 64 can be associated with the laser apparatus 46 to generate an alarm representing a jam condition.

Figure 5:
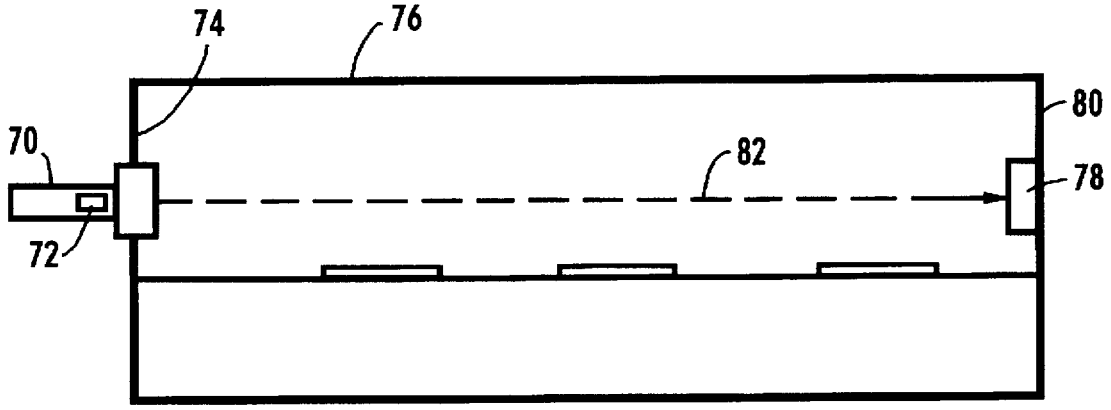
FIG. 5 is a schematic diagram of an alternate laser apparatus.

It is to be understood that alternatively, as schematically shown in FIG. 5, a laser apparatus 70 can be provided in which a laser generator 72 is provided at a first end 74 of a dryer 76 and a light receiver 78 is mounted at a second end 80 of the dryer 76. When no jam exists, a laser beam 82 that is produced by the laser generator 72 propagates to the receiver 78. When the receiver 78 detects the beam 82, it generates a "clear" signal indicating that no jam exists. On the other hand, when the laser beam 82 is blocked by a jam, the receiver generates a "jam" signal to indicate that a jam exists.

While the particular JAM DETECTOR FOR WOOD VENEER DRYER as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A veneer dryer, comprising:

a dryer housing including at least one conveyor for conveying veneer panels from a first end of the dryer toward a second end of the dryer;

a laser apparatus directing a laser beam above the conveyor, the laser apparatus generating a distance signal representative of the distance between the laser apparatus and an object intersecting the laser beam;

wherein the veneer panels establish an operating configuration, wherein each panels lays substantially flush against the conveyor and the panels are thereby conveyed through the dryer, and wherein the veneer panels can establish a jammed configuration, wherein plural panels are stacked; and wherein the laser apparatus is disposed such that the laser beam propagates from one end of the dryer housing to the other when the panels are in the operating configuration, and wherein the laser beam impinges on at least one panel when the panels are in the jammed configuration.

2. The veneer dryer of claim 1, wherein at least one of the ends of the dryer housing is covered by a wall, and the dryer further comprises a sight glass positioned in the wall to establish a light passageway into the dryer housing.

3. The veneer dryer of claim 2, wherein the laser apparatus is positioned outside the dryer housing and is disposed to direct the laser beam through the sight glass.

4. The veneer dryer of claim 1, further comprising:

a plurality of conveyors, the conveyors being horizontally oriented and arranged in a stacked relationship with each other; and a plurality of laser apparatus, each being associated with a respective conveyor.

5. The veneer dryer of claim 3, wherein the laser apparatus includes:

a laser beam generator;

a light detector for receiving reflections of the laser beam from an object in the path of the beam; and a processor in data communication with the laser beam generator and the light detector for determining a distance between the apparatus and the object.

6. In a veneer dryer, a combination, comprising:

a sight glass positioned on the dryer to establish a pathway for light from outside the dryer to inside the dryer;

a laser apparatus juxtaposed with the sight glass for directing a laser beam into the dryer and receiving a reflection of the beam, the laser apparatus generating a signal in response thereto representative of whether veneer panels in the dryer have jammed; and wherein the dryer includes a dryer housing and at least one conveyor for moving the veneer panels through the dryer housing, and the laser apparatus directs the laser beam above the conveyor, the laser apparatus generating a distance signal representative of the distance between the laser apparatus and an object intersecting the laser beam.

7. The combination of claim 6, further comprises a laser beam generator;

a light detector for receiving reflections of the laser beam from an object in the path of the beam; and a processor in data communication with the laser beam generator and the light detector for determining a distance between the apparatus and the object.

8. The combination of claim 7, wherein the veneer panels establish an operating configuration, wherein each panel lays substantially flush against the conveyor and the panels are thereby conveyed through the dryer, and wherein the veneer panels can establish a jammed configuration, plural panels are stacked, and the laser beam propagates from the sight glass to an end of the dryer housing when the panels are in the operating configuration, and wherein the laser beam impinges on at least one panel when the panels are in the jammed configuration.

9. The combination of claim 8, in further combination with the dryer, the combination further including:

a plurality of conveyors, the conveyors being horizontally oriented and arranged in a stacked relationship with each other; and a plurality of laser apparatus, each being associated with a respective conveyor.

10. A method for generating a signal representative of whether veneer panels in a veneer dryer have jammed, comprising the steps of:

(a) directing a light beam into the dryer;

(b) receiving a reflection of the light beam; and (c) generating the signal in response to the receiving step.

11. The method of claim 10, wherein the light beam is a laser beam and the method further comprises the step of:

generating the laser beam from outside the dryer and receiving the reflection outside the dryer.

12. The method of claim 11, further comprising the step of generating plural beams, each beam being associated with a respective conveyor in the dryer.

* * * * *